United States Patent [19]

Usagawa et al.

[11] Patent Number: 5,057,406

[45] Date of Patent: Oct. 15, 1991

[54] SILVER HALIDE PHOTOGRAPHIC MATERIAL

[75] Inventors: Yasushi Usagawa; Nobuaki Kagawa; Kazuhiro Yoshida, all of Hino, Japan

[73] Assignee: Konica Corporation, Tokyo, Japan

[21] Appl. No.: 347,094

[22] Filed: May 4, 1989

[30] Foreign Application Priority Data

May 7, 1988 [JP] Japan ..... 63-110848
May 20, 1988 [JP] Japan ..... 63-124453

[51] Int. Cl.[5] ..... G03C 1/84

[52] U.S. Cl. ..... 430/522; 430/510; 430/513; 430/517; 430/581; 430/583; 430/585; 430/588

[58] Field of Search ..... 430/522, 588, 513, 510, 430/517, 585, 581, 583

[56] References Cited

U.S. PATENT DOCUMENTS

| | | | |
|---|---|---|---|
| 3,832,212 | 8/1974 | Jenkins et al. | 430/495 |
| 4,263,397 | 4/1981 | Horikoshi et al. | 430/588 |
| 4,574,115 | 3/1986 | Adachi et al. | 430/522 |
| 4,839,265 | 6/1989 | Ohno et al. | 430/585 |

FOREIGN PATENT DOCUMENTS 453007 9/1974 Australia .

*Primary Examiner*—Charles L. Bowers, Jr.
*Assistant Examiner*—Thorl Chea
*Attorney, Agent, or Firm*—Finnegan, Henderson, Farabow, Garrett, and Dunner

[57] ABSTRACT

Silver halide photographic material having a hydrophilic colloidal layer that contains at least one cyanine dye with a 3H-pyrolopyridine, 4H-thienopyrrole, 6H-thienopyrrole, 4H-furopyrrole or 6H-furopyrrole nucleus which has in its dye molecule at least two acid groups or at least two substituents each having at least one $-CH_2CH_2OR$ group (where R is a hydrogen atom or an alkyl group).

26 Claims, No Drawings

SILVER HALIDE PHOTOGRAPHIC MATERIAL

BACKGROUND OF THE INVENTION

The present invention relates to a dye-containing silver halide photographic material. More particularly, the present invention relates to a silver halide photographic material that contains a hydrophilic colloidal layer tinted with an effective light-absorbing dye and which has reduced color remnant while exhibiting good aging stability.

With a view to absorbing light in a specific wavelength region it is common practice with silver halide photographic materials to tint photographic emulsion layers or other layers. If it is necessary to control the spectral composition of light to be incident on a photographic emulsion layer, a tinted layer is disposed on the side more remote from the base support than said photographic emulsion layer. This tinted layer is generally referred to as a filter layer. If more than one photographic emulsion layer is present as in a multilayer color photographic material, the filter layer may be located intermediate between adjacent emulsion layers.

When light scattered during or after passage through a photographic emulsion layer is reflected at the interface between the emulsion layer and the support or from the surface on the side of the light-sensitive material opposite to the emulsion layer, it re-enters the same photographic emulsion layer to cause a blurred image or an image with halo. In order to prevent this phenomenon, a tinted layer is provided between the photographic emulsion layer of interest and the support or on the side of the support opposite to that emulsion layer. This tinted layer is referred to as an anti-halation layer. An anti-halation layer may be disposed between adjacent layers in a multilayer color light-sensitive material.

Photographic emulsion layers are sometimes tinted for the purpose of preventing decrease in image sharpness due to light scattering in the emulsion layers (a phenomenon generally referred to as "irradiation").

The layers to be tinted are in most cases formed of a hydrophilic colloid, so water-soluble dyes are usually incorporated in those layers to tint them and such dyes must satisfy the following conditions:

(1) they should have an appropriate spectral absorption that suits the specific purpose of use;

(2) they should be photochemically inert (i.e., they should not cause chemically adverse effects, such as sensitivity drop or fogging, on the performance of a silver halide photographic emulsion layer of interest); and (3) they should be decolored or dissolved away during photographic processing to leave no deleterious tinting behind on the processed photographic material.

Heretofore, with a view to discovering dyes which satisfy the above-mentioned conditions, many efforts have been made and, in consequence, a variety of dyes have been proposed. These dyes include, for example, the oxonol dye described in British Patent 506,385, U.S. Pat. No. 3,247,127, etc., the styryl dye described in U.S. Pat. No. 1,845,404, the merocyanine dye described in U.S. Pat. No. 2,493,747, the cyanine dye described in U.S. Pat. No. 2,843,486, and the like. However, dyes which satisfy all of the above said conditions and which are therefore useable in photographic materials are very few, this having been the actual state prior to the creation of the present invention.

Photographic materials can be exposed and processed for image formation by a "scanner method". Image formation by a scanner method involves scanning of the original, exposing on a silver halide photographic material based on the resulting image signal, and forming a negative or positive image corresponding to the image on the original. A semiconductor laser is used as the most preferred light source for recording by this method since it has the following advantages: it is small in size, is inexpensive, allows for easy modulation, and is long-lived compared to He-Ne lasers and argon lasers. In addition, semiconductor lasers provide greater convenience in handling since they emit light in the infrared region and hence permit the use of a bright safelight if photographic materials that are sensitive to infrared light are employed.

An example of infrared absorbing dyes that satisfy these requirements is described in Japanese Patent Application (OPI) No. 62-123454 (the term "OPI" as used herein means an "unexamined published Japanese patent application") and it is a tricarbocyanine dye having at least three acid groups in the molecule. It has recently been found, however, that when this dye is applied to a silver halide photographic material, the aging stability of the material is not necessarily improved to a satisfactory extent and reduction in sensitivity or deterioration in color remnant sometimes takes place.

SUMMARY OF THE INVENTION

An object, therefore, of the present invention is to provide a silver halide photographic material that is capable of forming an image of good quality having high aging stability.

Another object of the present invention is to provide a silver halide photographic material that has reduced color remnant after photographic processing and which has high sensitivity to infrared light.

These objects of the present invention can be attained by a silver halide photographic material having a hydrophilic colloidal layer that contains at least one cyanine dye with a 3H-pyrrolopyridine, 4H-thienopyrrole, 6H-thienopyrrole, 4H-furopyrrole or 6H-furopyrrole nucleus which has in its dye molecule at least two acid groups or at least two substituents each having at least one —$OH_2CH_2OR$ group (where R is a hydrogen atom or an alkyl group).

The objects of the present invention can also be attained by a silver halide photographic material that has at least one silver halide emulsion layer on a base support, characterized in that said emulsion layer is spectrally sensitized with at least one spectral sensitizer selected from the group consisting of cationic di- and tri-carbocyanine dyes, and has a hydrophilic colloidal layer containing at least one cyanine dye with a 3H-pyrrolopyridine, 4H-thienopyrrole, 6H-thienopyrrole, 4H-furopyrrole or 6H-furopyrrole nucleus which has in its dye molecular at least two acid groups or at least two substituents each having at least one —$CH_2CH_2OR$ group (where R is a hydrogen atom or an alkyl group).

DETAILED DESCRIPTION OF THE INVENTION

The dye compounds to be used in the present invention are represented by the following general formula (I), (II) and (III)

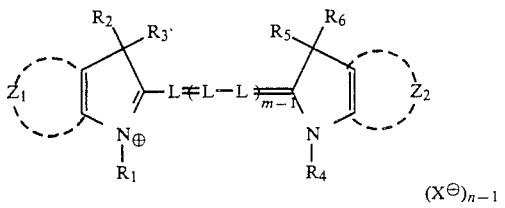

(I)

$(X^{\ominus})_{n-1}$

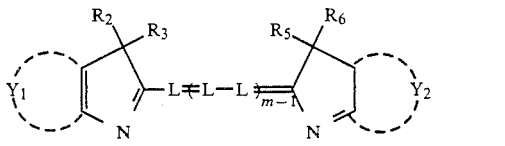

(II)

$(X^{\ominus})_{n-1}$

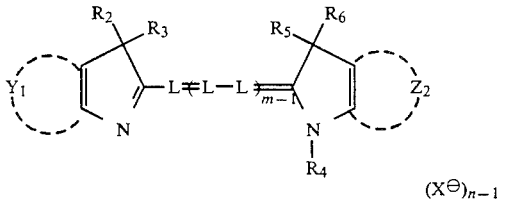

(III)

$(X^{\ominus})_{n-1}$ where $R_1$, $R_2$, $R_3$, $R_4$, $R_5$ and $R_6$ each represents an alkyl group; $Z_1$ and $Z_2$ each represents the group of non-metallic atoms necessary to form a pyrrolopyridine, thienopyrrole or furopyrrole ring;

$Y_1$ and 2 each represents the group of non-metallic atoms necessary to form a pyrrolopyridine ring, provided that the ring $Y_1$ contains

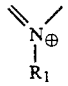

bond and the ring $Y_2$ contains

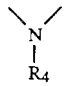

bond;

$R_1$–$R_6$ and $Z_1$ *l and Z2* in general formula (I), $R_1$–$R_6$ and $Y_1$ and $Y_2$ in general formula (II), and $R_1$–$R_6$ and $Y_1$ and $Z_2$ in general formula (III) each represents a group that enables the dye molecule to have at least two acid groups or at least two substituents each having at least one —$CH_2CH_2OR$ group (where R is a hydrogen atom or an alkyl group);

L is a methine group; $X^{\ominus}$ is an anion; m is an integer of 4–5; and n is an integer of 1 or 2, provided that n is 1 when the dye forms an intramolecular salt.

Examples of the acid group in the general formulas (I), (II) and (III) include a sulfonic acid group, a carboxylic acid group and a phosphonic acid group, as well as salts thereof. Illustrative salts include salts of alkali metals such as sodium and potassium, and salts of organic ammonium compounds such as ammonium, triethylamine and pyridine.

The alkyl group represented by $R_1$, $R_2$, $R_3$ $R_4$, $R_5$ and $R_6$ is preferably a lower alkyl group of 1–8 carbon atoms (e.g. methyl, ethyl, propyl, i-propyl or butyl) and may be substituted by the acid group described above or a substituent other than —$CH_2CH_2OR$ group.

The alkyl group represented by R is preferably a lower alkyl group having no more than 4 carbon atoms.

Examples of the substituent containing the —$CH_2CH_2$ OR group include: hydroxyethyl, hydroxyethoxyethyl, methoxyethoxyethyl, hydroxyethylcarbamoylmethyl, hydroxyethoxyethylcarbamoylmethyl, N,N-dihydroxyethylcarbamoylmethyl, hydroxyethylsulfamoylethyl, methoxyethoxyethoxycarbonylmethyl, etc.

Other substituents that may be possessed by $Z_1$, $Z_2$, $Y_1$ and $Y_2$ include sulfo (including its salts), carboxyl (including its salts), hydroxyl, cyano, halogen (e.g. fluorine, chlorine or bromine), etc.

The methine group represented by L may also have a substituent and illustrative substituents include: substituted or unsubstituted lower alkyl groups having 1–5 carbon atoms (e.g., methyl, ethyl, 3-hydroxypropyl, 2-sulfoethyl, etc.), halogen atoms (e.g. fluorine, chlorine, bromine, etc.), aryl groups (e.g., phenyl), and alkoxy groups (e.g., methoxy and ethoxy). Substituents on methine groups may be bonded together to form a 6-membered ring containing three methine groups (e.g., 4,4-dimethylcyclohexene ring).

The anion represented by $X^{\ominus}$ is not limited in any particular way but may be exemplified by halide ions, p-toluenesulfomate ions, ethyl sulfate ions, etc.

The cyanine dye to be used in the present invention is preferably a hepta- or non-methine cyanine dye.

The following are non-limiting examples of the dye compounds represented by the general formulas (I), (II) and (III) which may be used in the present invention (these compounds are hereinafter referred to as the "dyes of the present invention").

Illustrative Dye Compounds

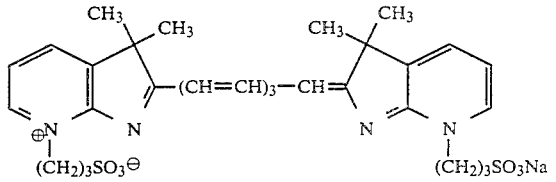

(1)

-continued
Illustrative Dye Compounds
(2)
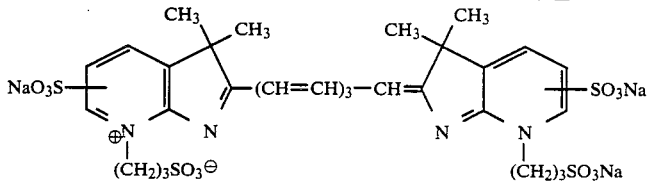
(3)
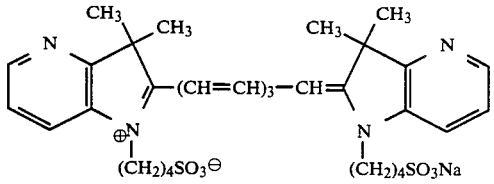
(4)
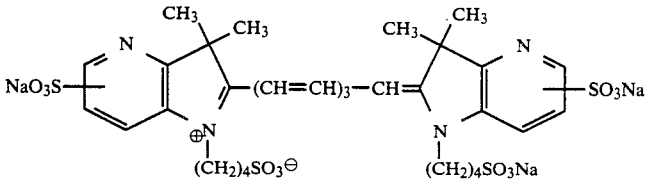
(5)
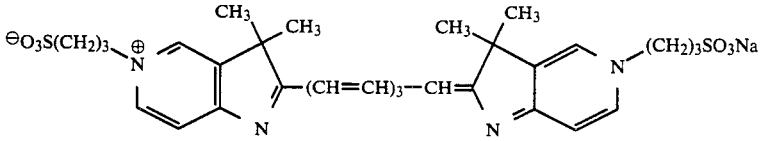
(6)
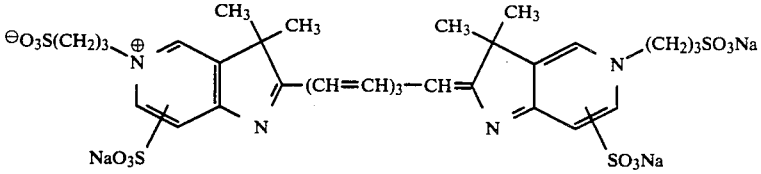
(7)
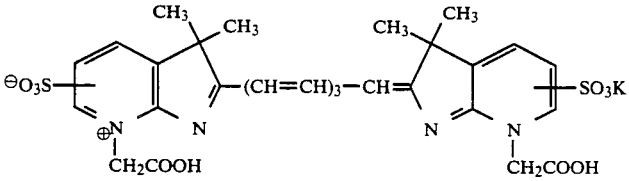
(8)
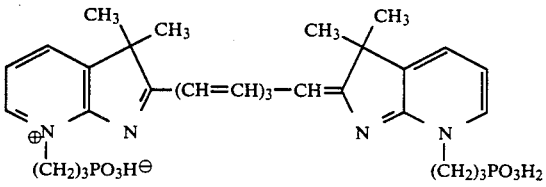
(9)
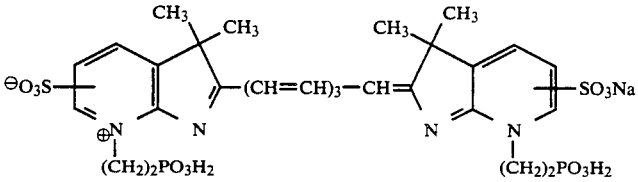
(10)
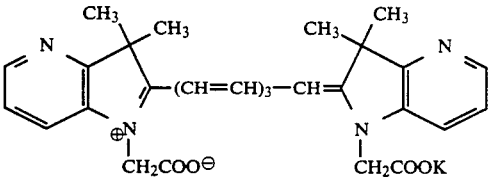

-continued
Illustrative Dye Compounds
(11)
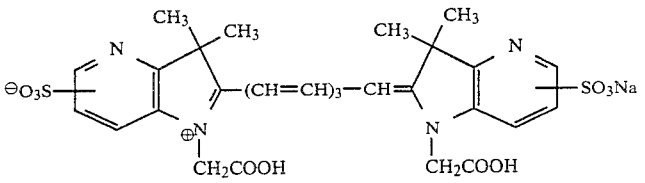
(12)
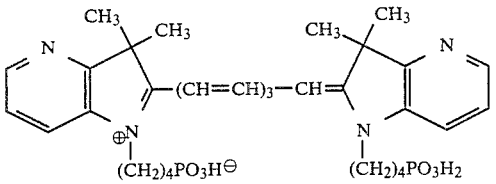
(13)
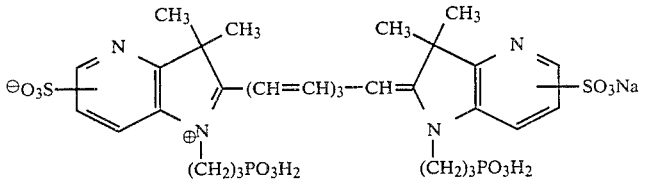
(14)
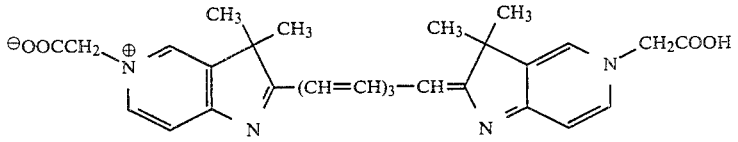
(15)
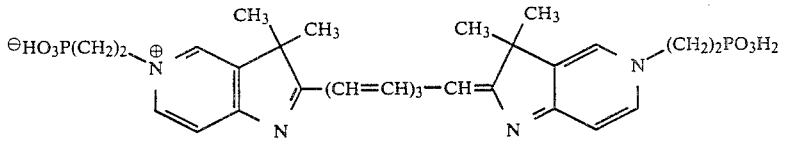
(16)
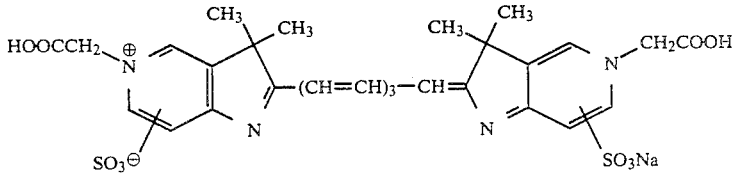
(17)
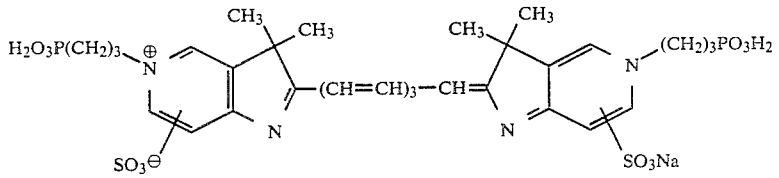
(18)
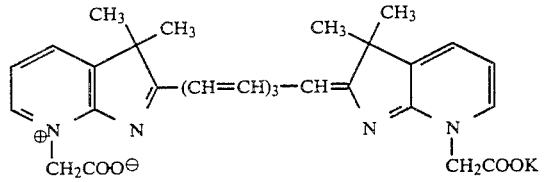
(19)
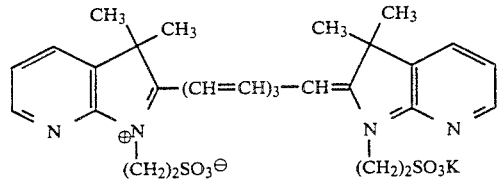

-continued
Illustrative Dye Compounds
(20)
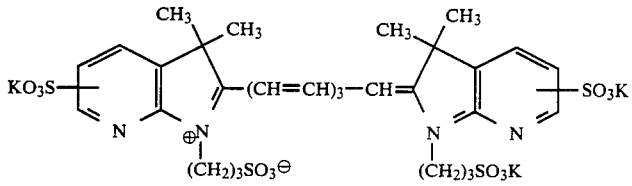
(21)
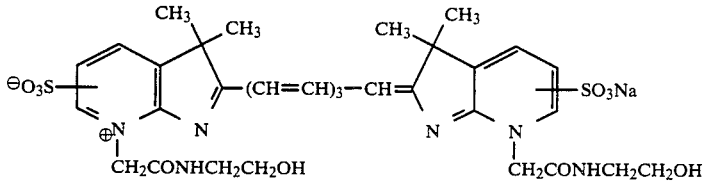
(22)
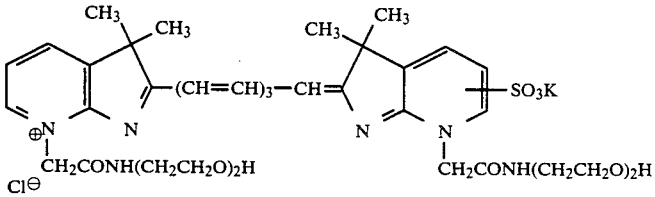
(23)
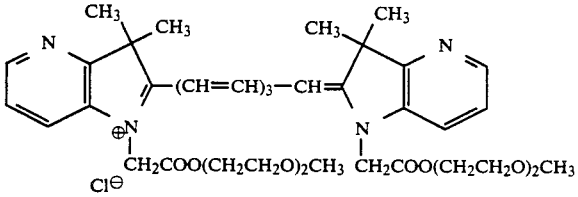
(24)
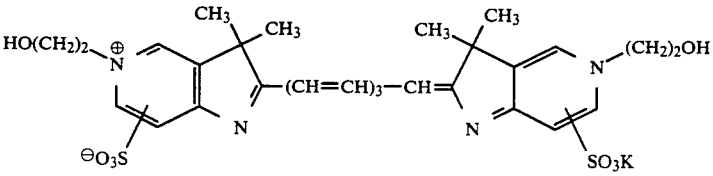
(25)
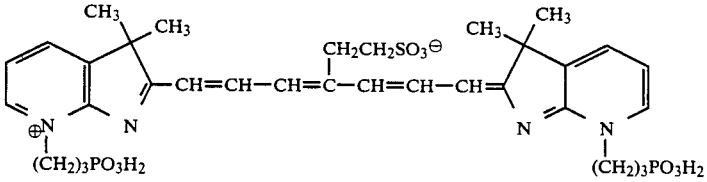
(26)
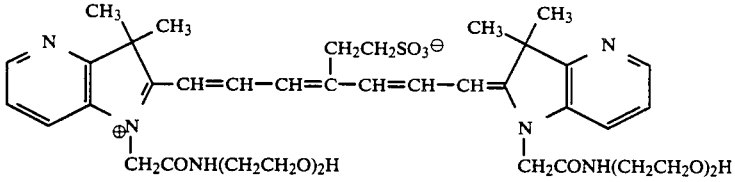
(27)
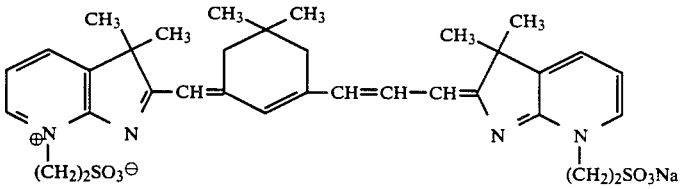

-continued
Illustrative Dye Compounds
(28)
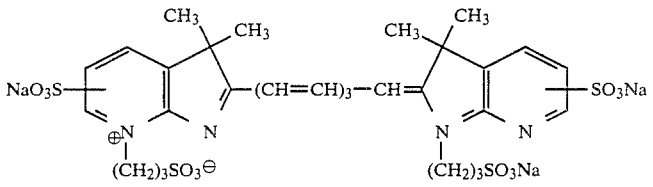
(29)
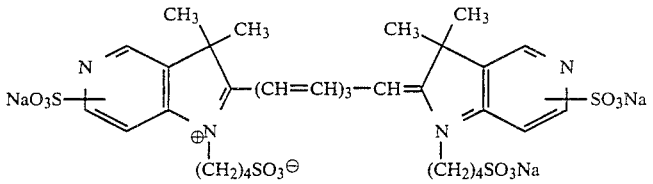
(30)
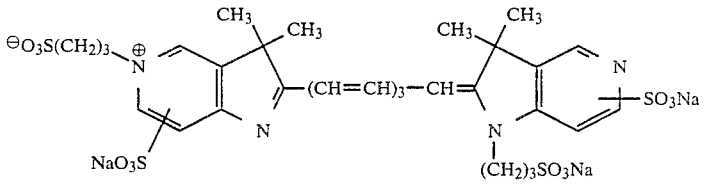
(31)
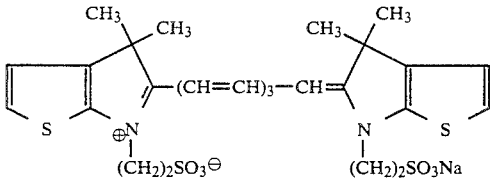
(32)
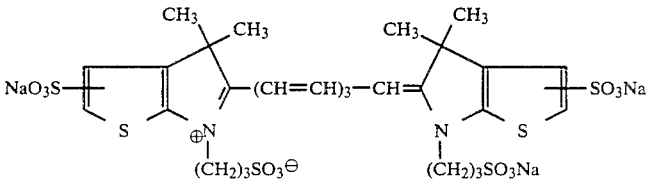
(33)
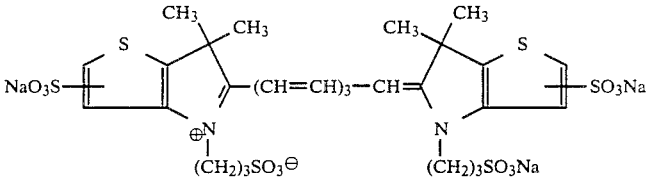
(34)
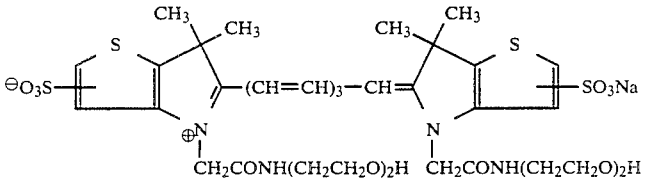
(35)
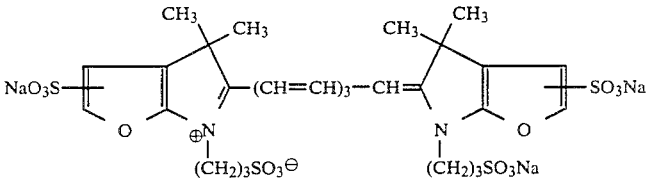

-continued
Illustrative Dye Compounds
(36)
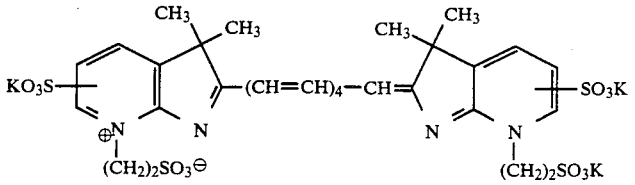
(37)
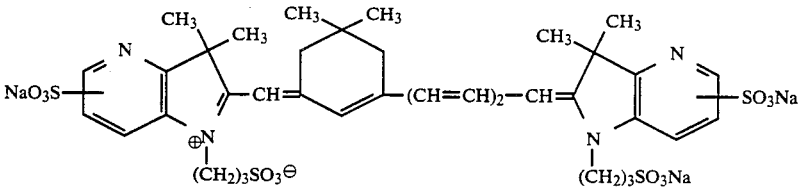
(38)
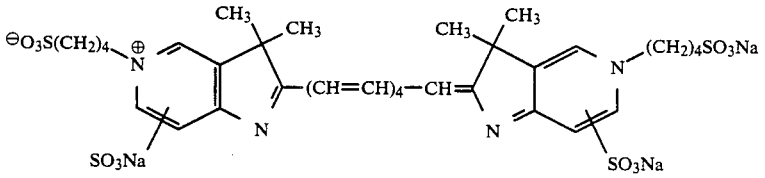
(39)
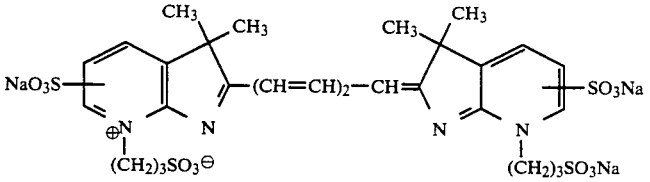
(40)
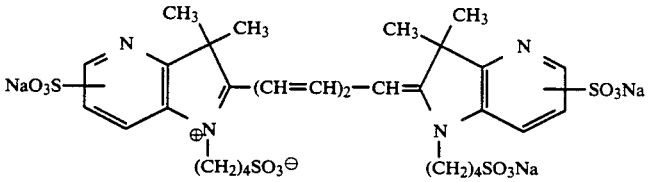
(41)
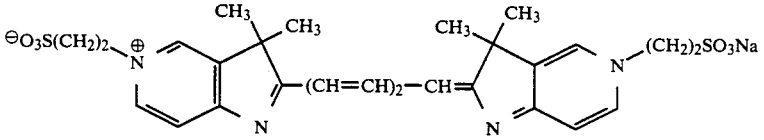
(42)
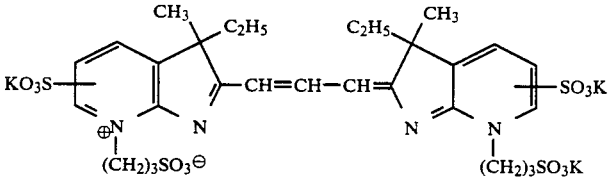
(43)
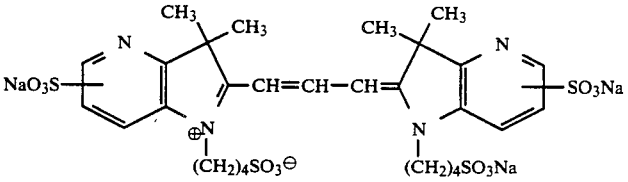
(44)
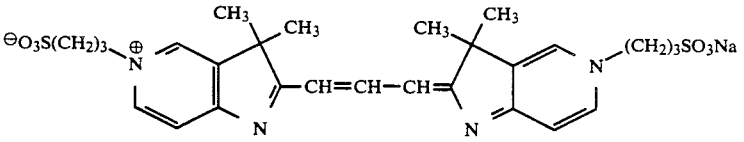

-continued

Illustrative Dye Compounds (45)

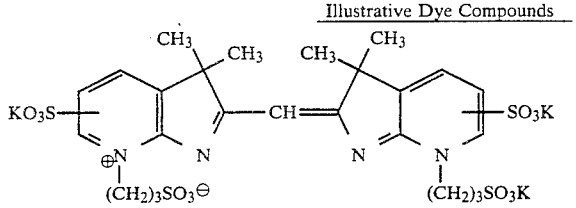

The dyes of the present invention may be synthesized with reference to J. Chem. Soc., 189, 1933, U.S. Pat. No. 2,895,955, Japanese Patent Application (OPI) No. 123454/1987, etc.

The dyes of the present invention may have the following compounds as their nuclei:

(A)

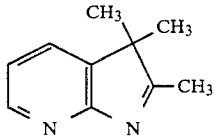

(B)

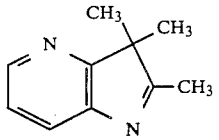

(C)

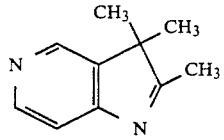

(D)

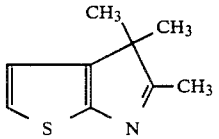

(E)

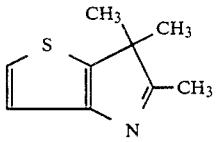

(F)

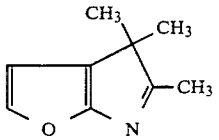

(G)

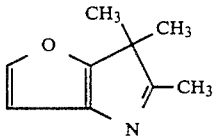

Compound (A) may be synthesized by the methods described in J. Chem. Soc., 3202, 1959 and British Patent 870,753.

Compound (B) may be synthesized by the method described in J. Chem. Soc., 584, 1961.

Compound (C) may be synthesized by the method described in British Patent 841,588.

Compound (D) may be synthesized by the methods described in Chemical Abstracts (CA), 62, 10438c and ibid., 71, 22045m.

Compound (E) may be synthesized by the method described in CA 71, 22045m.

Compounds (F) and (G) may be synthesized by similar methods.

The nuclei described above may optionally be subjected to suitable treatments such as quaternization and sulfonation. Alternatively, N-alkyl-N-pyridylhydrazine may be synthesized in accordance with the methods described in J. Chem. Soc., 3202, 1959 and ibid., 584, 1961 and is subsequently subjected to cyclization by way of hydrazone, optionally followed by an acid treatment to obtain a 1-alkyl-substituted-3H-pyrolopyridine derivative, which may be used as the starting material.

The quaternized or optionally sulfonated nucleus compounds described above may be reacted with a suitable methine chain donor so as to readily obtain the intended dyes of the present invention.

If a glutaconaldehyde dianil hydrochloride is used as a methine chain donor, a heptamethine dye is obtained, and if a propenedianil hydrochloride is used, a pentamethine dye is obtained. If a trimethine dye is to be obtained, a diphenylformamidine hydrochloride may be used. A monomethine dye can be synthesized in the usual manner by treating a nucleus compound having an alkylthio group at the active site. If nonamethine dyes are to be obtained, one may use as methine chain donors the compounds described on pages 249–251 of F. M. Hamer, "The Cyanine Dyes and Related Compounds", 1964, Interscience Publishers.

The dyes of the present invention which are represented by the general formulas (I), (II) and (III) may be used as anti-irradiation dyes in silver halide emulsions. Alternatively, they may be incorporated in non-light-sensitive hydrophilic colloidal layers and used as filter dyes or antihalation dyes. Depending on the specific object of use, these dyes may be used in combination with themselves or with other dyes. The dyes of the present invention may be readily incorporated in silver halide emulsion layers or other hydrophilic colloidal layers by conventional methods. Normally, a dye or an organic or inorganic alkali salt of the dye is dissolved in water to make an aqueous dye solution of a suitable concentration, which is added to a coating solution and applied by a known method so as to incorporate the dye in a light-sensitive material. The content of the dyes of the present invention varies with the object of use but they are generally coated in amounts ranging from 1 to 800 mg per square meter of the area of the silver halide photographic material.

The silver halide photographic material of the present invention has at least one silver halide emulsion layer spectrally sensitized with an infrared spectral sensitizer such as a cationic di- or tri-carbocyanine dye. The cationic di- or tri-carbocyanine spectral sensitizer for the infrared region which is to be used in the present invention is preferably represented by the following general formula (II-a) or (II-b):

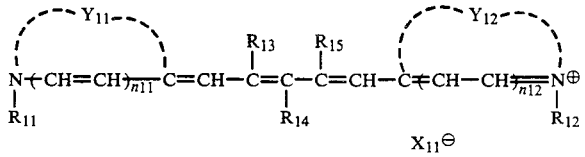

(II-a)

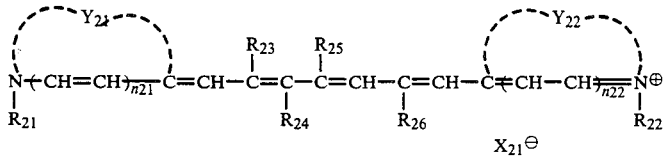

(II-b)

where $Y_{11}$, $Y_{12}$, $Y_{21}$ and $Y_{22}$ each represents the group of non-metallic atoms necessary to complete a 5- or 6-membered nitrogenous hetero ring, which may be illustrated by a benzothiazole ring, a naphthotiazole ring, a benzoselenazole ring, a naphthoselenazole ring, a benzoxazole ring, a naphthoxazole ring, a quinoline ring, a 3,3-dialkylindolenine ring, a benzimidazole nucleus, a pyridine ring, etc.; these hetero rings may be substituted by a lower alkyl group, an alkoxy group, a hydroxyl group, an aryl group, an alkoxycarbonyl group, or a halogen atom;

$R_{11}$, $R_{12}$, $R_{21}$ and $R_{22}$ each represents a substituted or unsubstituted alkyl, aryl or aralkyl group;

$R_{13}$, $R_{14}$, $R_{15}$, $R_{23}$, $R_{24}$, $R_{25}$ and $R_{26}$ each represents a hydrogen atom, a substituted or unsubstituted alkyl, alkoxy, phenyl, benzyl or

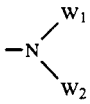

(where $W_1$ and $W_2$ each represents a substituted or unsubstituted alkyl, the alkyl portion having 1–18, preferably 1–4, carbon atoms, or aryl group), provided that $W_1$ may combine with $W_2$ to form a 5- or 6-membered nitrogenous hetero ring;

$R_{13}$ and $R_{15}$, as well as $R_{23}$ and $R_{25}$ may combine to form a 5- or 6-membered ring; $X_{11}$ and $X_{21}$ each represents an anion; and $n_{11}$, $n_{12}$, $n_{21}$ and $n_{22}$ each represents 0 or 1.

The following are non-limiting examples of the spectral sensitizers that may be used in the present invention (which are hereinafter referred to as the "spectral sensitizers of the present invention"). In the following list, compounds II-1 to II-13 are represented by the general formula (II-b) and compounds II-14 to II-21 are represented by the general formula (II-1).

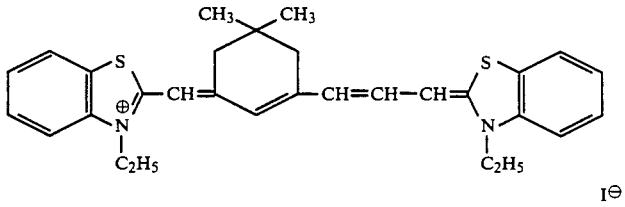

II-1

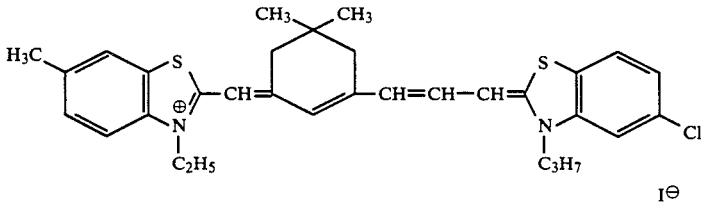

II-2

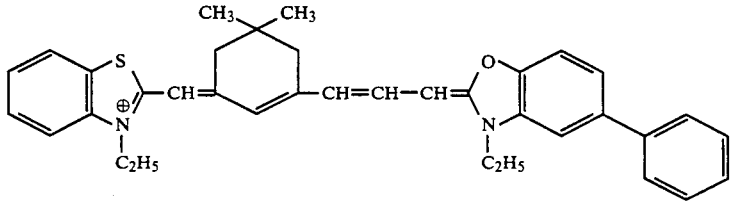

II-3

-continued
II-4
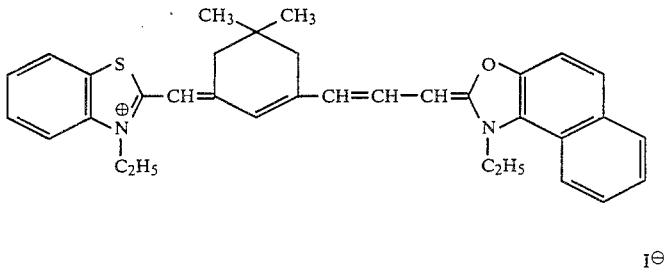
$I^{\ominus}$
II-5
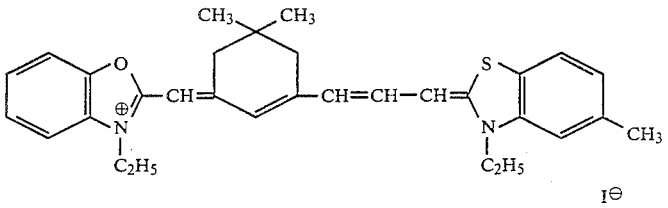
$I^{\ominus}$
II-6
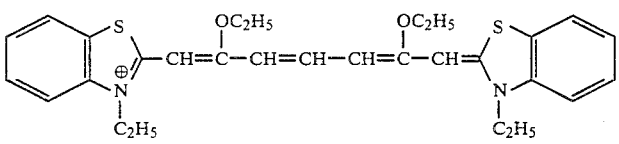
$I^{\ominus}$
II-7
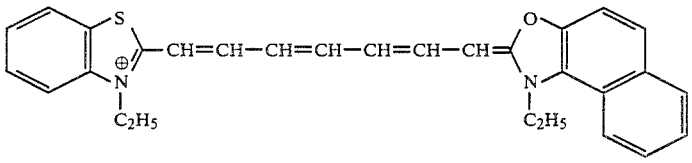
$I^{\ominus}$
II-8
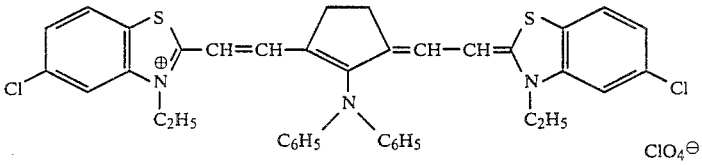
$ClO_4^{\ominus}$
II-9
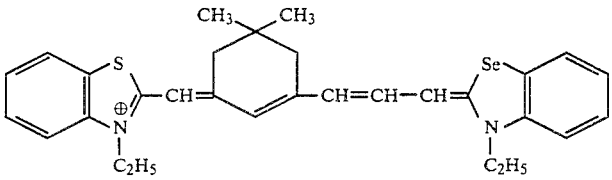
$I^{\ominus}$
II-10
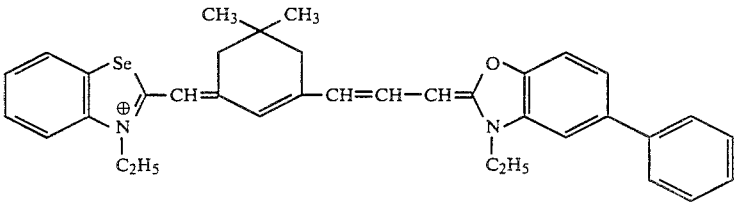
$I^{\ominus}$ -continued
II-11
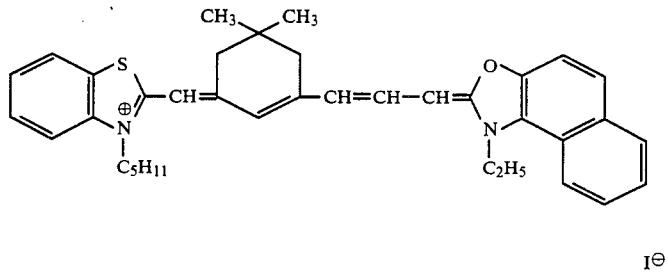
$I^{\ominus}$
II-12
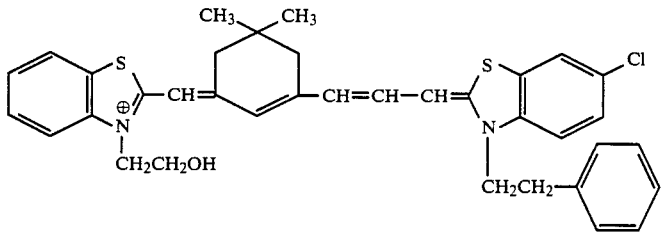
$I^{\ominus}$
II-13
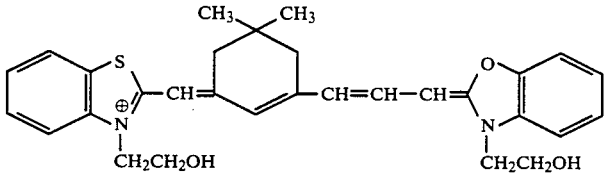
$I^{\ominus}$
II-14
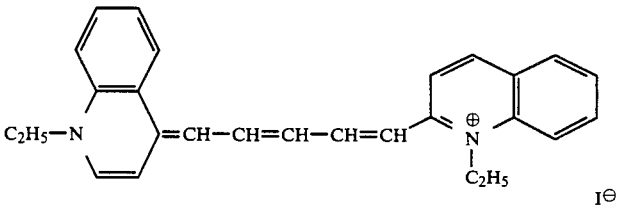
$I^{\ominus}$
II-15
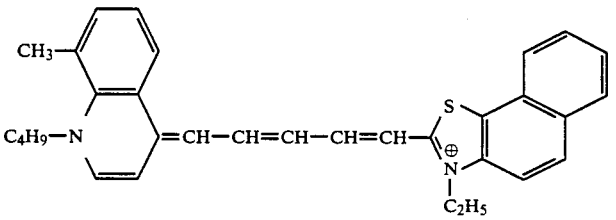
$I^{\ominus}$
II-16
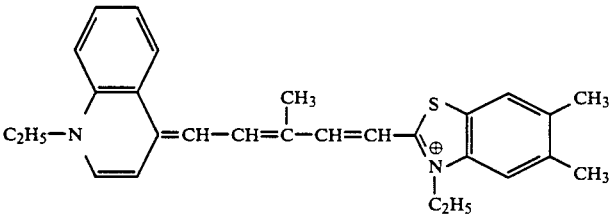
$I^{\ominus}$ -continued

II-17

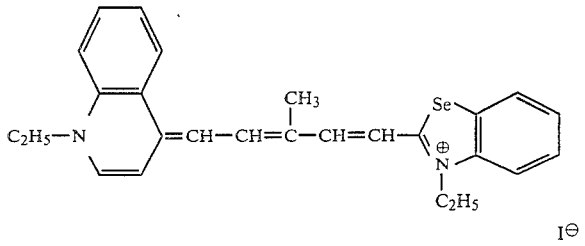

II-18

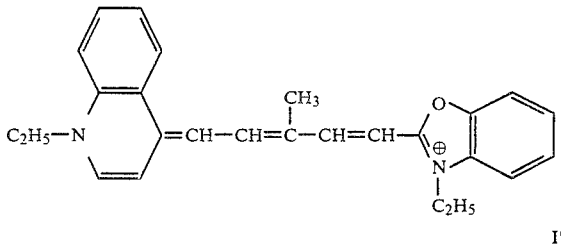

II-19

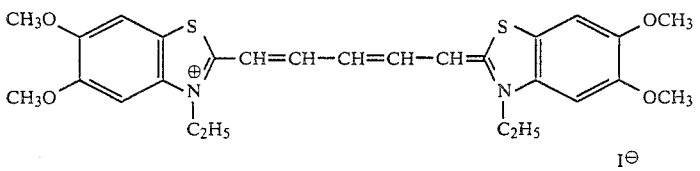

II-20

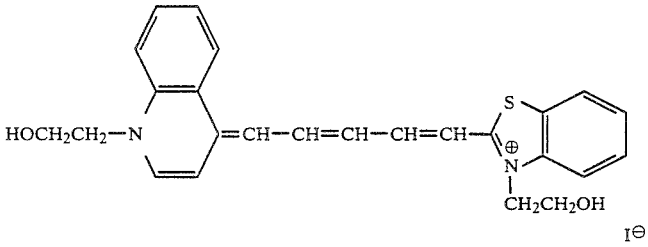

II-21

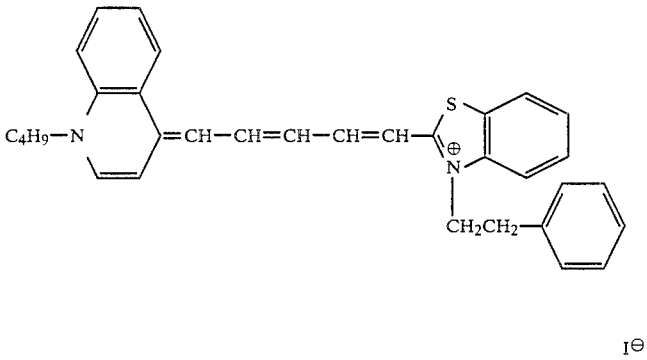

The spectral sensitizers of the present invention are incorporated in silver halide photographic emulsion layers in amounts that range preferably from 1 mg to 2 g, more preferably from 5 mg to 1 g, per mol of silver halide.

The spectral sensitizers of the present invention may be dispersed directly into the emulsion. Alternatively, they are first dissolved in a suitable solvent such as methyl alcohol, ethyl alcohol, methyl cellosolve, acetone, water, pyridine or a mixture thereof, and the resulting solution is added to the emulsion.

The spectral sensitizers of the present invention may be used either on their own or as admixtures. They may also be used in combination with other spectral sensitizers. When two or more spectral sensitizers are to be used, their total amount is preferably within the range specified two paragraphs ago.

The spectral sensitizers of the present invention can be readily synthesized with reference to U.S. Pat. No. 2,503,776, British Patent 742,112, French Patent 2,065,662 and Japanese Patent Publication No. 2346/1965.

The silver halide emulsion to be used in the present invention may contain any kind of silver halides that are used in ordinary silver halide emulsions, such as silver bromide, silver iodide, silver iodobromide, silver iodochloride, silver chlorobromide, silver chloroiodobromide and silver chloride.

The silver halide grains used in the silver halide emulsion may be prepared by either the acid method, neutral method or ammoniacal method. The grains may be grown at one time or they may be grown after making seed grains. The method of making seed grains may be the same as or different from the method of growing them.

In preparing a silver halide emulsion, halide ions and silver ions may be mixed as such or, alternatively, either halide ions or silver ions may be mixed with a solution containing the other ion. Silver halide grains can also be produced by simultaneously adding halide ions and silver ions over time with the pH and/or pAg in the mixing vessel being controlled in consideration of the critical growth rate of silver halide crystals. This latter method has the advantage of producing silver halide grains that are regular in crystallographic form and which are substantially uniform in grain size. After the grain growth, the halide composition of the grains may be altered by a conversion process.

If desired, a silver halide emulsion may be produced in the presence of a silver halide solvent for the purpose of controlling various parameters including the size of silver halide grains, their shape, grain size distribution and the growth rate of grains.

In the process of formation and/or growth of silver halide grains used in a silver halide emulsion, at least one metal ionic species selected from the group consisting of cadmium salt, zinc salt, lead salt, thallium salt, iridium salt (or a complex salt containing the same), a rhodium salt (or a complex salt containing the same) and an iron salt (or a complex salt containing the same) may be added so that these metallic elements may be present within and/or on the grains. Alternatively, the grains may be placed in a suitable reducing atmosphere so as to provide reduction sensitization nuclei within and/or on the grains.

In the preparation of silver halide emulsions, unwanted soluble salts may be removed after completion of the growth of silver halide grains. If desired, such soluble salts may be left unremoved from the grown silver halide grains. Removal of such soluble salts may be accomplished by the method described under II in Research Disclosure (hereinafter abbreviated as RD) No. 17643.

The silver halide grains used in the present invention may have a homogeneous distribution of silver halide composition throughout the grain; alternatively, they may be core/shell grains having different silver halide compositions in the interior and surface layer of the grain.

The silver halide grains used in the present invention may be either such that latent image is predominantly formed on their surface or such that it is predominantly formed within the grain.

The silver halide grains used in the present invention may have a regular crystallographic form such as a cube, an octahedron or a tetradecahedron, or they may have an anomalous crystallographic form such as a sphere or a plate, or a crystal defect such as twin surface. These grains may have any proportions of {100} and {111} faces. Grains having combinations of these crystallographic forms may also be used. Grains having various crystallographic forms may be used as admixtures.

The silver halide grains preferably have an average size (as expressed by the diameter of an equivalent circle whose area is the same as the projected area) of no more than 2 μm, with 0.7 μm or below being particularly preferred.

The silver halide emulsion used in the present invention may have any grain size distribution. It may have a broad grain size distribution (hereinafter referred to as a "polydispersed emulsion"). Alternatively, emulsions having a narrow grain size distribution (hereinafter referred to as "monodispersed emulsions"). The term "monodispersed emulsions" as used herein means emulsions in which the standard deviation of grain size distribution divided by the average grain size is no more than 0.20, where the grain size is expressed by the diameter of a spherical silver halide grain, or the diameter of the projected area of a non-spherical grain as reduced to a circular image of the same area) may be used either independently or as admixtures. If desired, a polydispersed emulsion may be used as an admixture with a monodispersed emulsion.

Two or more silver halide emulsions separately prepared may be used as admixtures.

The light-sensitive material of the present invention includes not only a black-and-white photographic material but also a color photographic material. A light-sensitive material for printing may be given as an example of the former type of photographic material. The number of silver halide emulsion layers may be two or more. The silver deposit is desirably within the range of 1–8 $g/m^2$.

Depending upon a specific object, the light-sensitive material of the present invention may incorporate various additives. A detailed description of useful additives is given in RD, No. 17643 (December 1978) and ibid., No. 18716 (November 1979) and the relevant portion of the description is summarized in the table below.

There is no particular limitation on the conditions for exposure, development and subsequent processing of the light-sensitive material of the present invention and reference may be had to the description in RD, No. 17643, pp. 28–30.

| Additive | RD 17643 | RD 18716 |
|---|---|---|
| 1. Chemical sensitizer | p. 23 | p. 648, right col. |
| 2. Sensitivity improver<br>Supersensitizer | pp. 23–24 | p. 648, right col.<br>p. 649, right col. |
| 3. Brightener | p. 24 | |
| 4. Antifoggant<br>Stabilizer | pp. 24–25 | p. 649, right col. |
| 5. Light absorber<br>Filter dye<br>UV absorber | pp. 25–26 | p. 649, right col. to<br>p. 650, left col. |
| 6. Antistain agent | p. 25<br>right col. | p. 650, left and right col. |
| 7. Hardener | p. 26 | p. 651, left col. |
| 8. Binder | p. 26 | p. 651, left col. |
| 9. Plasticizer<br>Lubricant | p. 27 | p. 650, right col. |
| 10. Coating aid<br>Surfactant | pp. 26–27 | p. 650, right col. |
| 11. Antistat | p. 27 | p. 650, right col. |

For purposes such as dimensional stability, photographic emulsion layers in the light-sensitive material using silver halide emulsions and other hydrophiliccolloidal layers may incorporate latices or dispersions of water-insoluble or slightly water-soluble synthetic polymers.

Various base supports may be used depending upon the specific use of the light-sensitive material of the present invention and illustrative examples include: baryta paper, polyethylene-coated paper, polypropylene synthetic paper, glass plate, cellulose acetate, cellulose nitrate, polyester (e.g. polyethylene terephthalate) films, polyamide films, polypropylene films, polycarbonate films, polystyrene films, etc.

It is possible to incorporate various additives in the base support, and they include inorganic white pigments, inorganic coloring pigments, dispersants, brighteners, antistatic agents, anti-oxidizing agents and stabilizers. The surface of the base support is activated by a suitable method such as corona discharge treatment or flame treatment. In addition, a subbing layer, if necessary, may be provided.

The light-sensitive material of the present invention may be processed by any of the known methods of photographic processing, using any known processing solutions. The processing temperatures are normally selected from the range of 18–50° C. but temperatures lower than 18° C. or higher than 50° C. may also be employed. Depending upon a specific object, either black-and-white photographic processing (for forming a silver image) or color photographic processing (for forming a dye image) may be performed.

The following examples are provided for the purpose of further illustrating the present invention but are in no way to be taken as limiting.

EXAMPLE 1

Gelatin (3.5 g) was dissolved in distilled water (35 ml). To the solution, 5 ml of an aqueous solution containing $2.0\times10^{-4}$ moles of illustrative dye compound (1), (2) or (3) of the present invention was added, followed by addition of a 10% aqueous saponin solution (1.25 ml) and 1% formalin (0.75 ml), and water to make a total amount of 50 ml. The so prepared dye solutions were coated on acetyl cellulose film bases and dried to make sample Nos. 1, 2 and 3. Comparative samples (Nos. 4 and 5) were prepared by the same method except that comparative dye compounds (A) and (B) shown below were substituted:

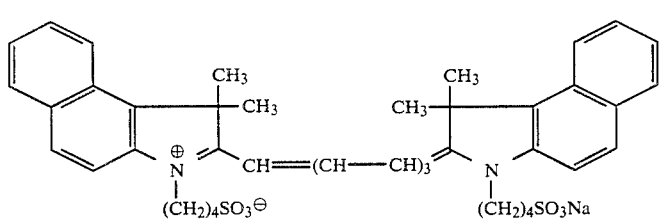

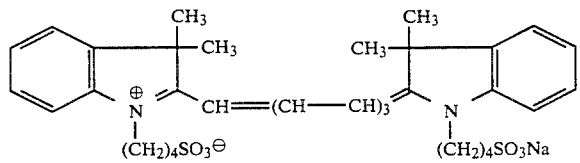

Each of the samples thus prepared was immersed in a developer (for its composition, see below) at 25° C. for 1 minute. Following 20-sec rinsing, the samples were dried.

| Developer's composition | |
|---|---|
| Metol | 3.0 g |
| Sodium sulfite (anhydrous) | 45.0 g |
| Hydroquinone | 12.0 g |
| Sodium carbonate (monohydrate) | 80.0 g |
| Potassium bromide | 2.0 g |
| Water to make | 1,000 ml |

The visible spectrum of each sample was measured both before and after immersion in the developer and the percentage of decoloration was determined from the difference in absorbance at wavelength for maximum absorption. The results are shown in Table 1.

$$\text{Percentage of decoloration} = \frac{E_1 - E_2}{E_1} \times 100\ (\%)$$

(where $E_1$ is the absorbance before immersion in the developer, and $E_2$ is the absorbance after immersion in the developer).

TABLE 1

| Sample | Dye compound | Percentage of decoloration |
|---|---|---|
| 1 | illustrative dye compound (1) of the invention | 100% |
| 2 | illustrative dye compound (2) of the invention | 100% |
| 3 | illustrative dye compound (3) of the invention | 100% |
| 4 | comparative dye compound (A) | 85% |
| 5 | comparative dye compound (B) | 90% |

As is clear from Table 1, the dyes of the present invention showed more extensive decoloration than the comparative dyes.

EXAMPLE 2

A gelatin emulsion of silver chloroiodobromide was prepared; it consisted of 80 mol% AgCl, 19.5 mol% AgBr and 0.5 mol% AgI and had an average grain size of 0.32 μm. To this emulsion, a 2,4-dichloro-6-hydroxy-1,3,5-triazine sodium salt (1% aq. sol.) and saponin (10% aq. sol.) were added in respective amounts of 35 ml and 50 ml per kg of the emulsion (containing 48 g of silver and 75 g of gelatin). The mixture was coated on a subbed polyethylene terephthalate film base to give a silver deposit of 50 mg per 100 cm:, and dried.

The resulting emulsion layer was overlaid with a Protective layer (for its composition, see below) in a dry thickness of 2 μm, thereby preparing sample No. 6.

| Protective layer | |
|---|---|
| Gelatin | 40 g |
| Water | 850 ml |
| Illustrative dye compound (4) of the invention (2% aq. sol.) | 100 ml |
| 2,4-Dichloro-6-hydroxy-1,3,5-triazine sodium salt (1% aq. sol.) | 20 ml |
| Saponin (10% aq. sol.) | 30 ml |

Additional samples (Nos. 7, 8, 9 and 10) were prepared by the same procedures as preparation of sample No. 6 except that illustrative dye compound (4) was replaced by either of illustrative dye compounds (5) and (6) of the present invention or either of comparative dye compounds (A) and (B) used in Example 1.

Each of the samples was cut into small pieces, which were exposed through an optical wedge and processed with a developer and a fixing solution having the compositions shown below. The development was performed at 20° C. for 1.5 minutes whereas the fixing was performed at 20° C. for 2 minutes. Following rinsing at 20° C. for 5 minutes, the pieces were dried.

| Developer | |
|---|---|
| Hydroquinone | 15 g |
| Formaldehyde/sodium hydrogen sulfite adduct | 55 g |
| Anhydrous sodium sulfite | 3 g |
| Sodium carbonate (monohydrate) | 80 g |
| Boric acid | 5 g |
| Potassium bromide | 2.5 g |
| Ethylenediaminetetraacetic acid disodium salt | 2 g |
| Water to make | 1,000 ml |
| **Fixing solution** | |
| Sodium thiosulfate | 160 g |
| Anhydrous sodium sulfite | 14 g |
| Glacial acetic acid | 12 ml |
| Borax | 12 g |
| Potassium alum | 5 g |
| Water to make | 1,000 ml |

Ten pieces of each processed sample were superposed and checked for staining on the test pieces. The results are shown in Table 2.

TABLE 2

| Sample | Dye compound | Staining |
|---|---|---|
| 6 | illustrative dye compound (4) of the invention | negative |
| 7 | illustrative dye compound (5) of the invention | negative |
| 8 | illustrative dye compound (6) of the invention | negative |
| 9 | comparative dye compound (A) | positive |
| 10 | comparative dye compound (B) | positive |

Staining occurred in the samples using comparative dye compounds (A) and (B). On the other hand, the dyes of the present invention caused no staining at all on account of improved washout and decoloration properties.

EXAMPLE 3

A silver chlorobromide emulsion was prepared; it consisted of 70 mol% AgCl and 30 mol% AgBr and had an average grain size of 0.3 μm. To this emulsion, formalin (1% aq. sol.) and saponin (10% aq. sol.) were added in respective amounts of 20 ml and 50 ml per kg of the emulsion (containing 48 g of silver and 75 g of gelatin). The mixture was coated on a subbed polyethylene terephthalate film base, and the resulting emulsion layer was overlaid with a protective layer (for its composition, see below).

| Protective layer | |
|---|---|
| Gelatin | 40 g |
| Water | 960 ml |
| Formalin (1% aq. sol.) | 12 ml |
| Saponin (10% aq. sol.) | 30 ml |

The back side of the base support having the emulsion layer and the protective layer formed thereon was coated with a gelatin layer (for its composition, see below) to give a dry thickness of 3 μm, thereby making sample No. 11.

| Gelatin layer | |
|---|---|
| Gelatin | 50 g |
| Water | 835 ml |
| Illustrative dye compound (7) of the invention (2% aq. sol.) | 100 ml |
| Formalin (1% aq. sol.) | 15 ml |
| Saponin (10% aq. sol.) | 50 ml |

Additional samples (Nos. 12 and 13) were prepared by the same method except that illustrative dye compound (7) was replaced by illustrative dye compound (9) of the present invention or comparative dye compound (C) (See below).

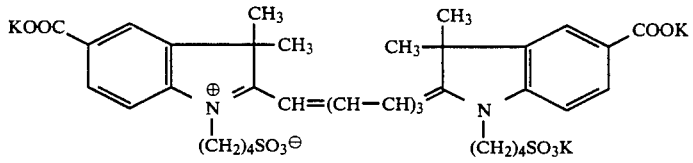

(C)

After pieces of each sample were processed photographically as in Example 2, ten pieces of each processed sample were superposed and evaluated for resistance to staining. The results are shown in Table 3.

TABLE 3

| Sample | Dye compound | Staining |
|---|---|---|
| 11 | illustrative dye compound (7) of the invention | negative |
| 12 | illustrative dye compound (9) of the invention | negative |
| 13 | comparative dye compound (C) | POSITIVE |

As Table 3 shows, staining occurred in the sample using comparative dye compound (C) but there was no staining at all in the samples using the dyes of the present invention. Using these dyes, light-sensitive materials having improved resistance to halation could be fabricated without causing any deleterious effects such as fogging and desensitization on photographic emulsions.

EXAMPLE 4

A base support composed of polyethylene-coated paper was coated successively with the following layers, the first layer coming the closest to the support, so as to prepare a color photographic material (sample No. 14).

First layer: Blue-sensitive silver halide emulsion layer (AgClBr emulsion with 90 mol% AgBr sensitized with a spectral sensitizer) that contained yellow coupler {α-pivalyl-α-(1-benzyl-2-phenyl-3,5-dioxotriazolidin-4-yl) -2'-chloro-5'-[γ-(2,4-di-t-amylphenoxy)butylamido]acetanilide}, hardener (dichlorotriazine) and surfactant (saponin) was coated to give a silver deposit of 3.5 mg/100 $cm^2$.

Second layer: Gelatin layer (intermediate layer)

Third layer: Green-sensitive silver halide emulsion layer (AgClBr emulsion with 80 mol% AgBr sensitized with a spectral sensitizer) that contained magenta coupler {1-(2,4,6-trichlorophenyl)-3-[3-(2,4-di-t-amylphenoxyacetamido)benzamido]- 5-pyrazolone}, hardener (dichlorotriazine) and surfactant (saponin) was coated to give a silver deposit of 4.5 mg/100 $cm^2$.

Fourth layer: Gelatin layer (intermediate layer)

Fifth layer: Red-sensitive silver halide emulsion layer (AgClBr emulsion with 75 mol% AgBr sensitized with a spectral sensitizer) that contained cyan coupler [2,4-dichloro-3-methyl-6-(2,4-di-t-amylphenoxyacetamido)phenol], hardener (dichlorotriazine) and surfactant (saponin) was coated to give a silver deposit of 2.0 mg/100 $cm^2$.

Sixth layer: Gelatin layer (protective layer)

Additional samples (Nos. 15 and 16) were prepared by the same method as preparation of sample No.14 except that the coating solution for the third layer (green-sensitive emulsion layer) contained 200 ml of a 2% aq. sol. of illustrative dye compound (43) of the present invention or comparative dye compound (D) (see below) per kg of the emulsion.

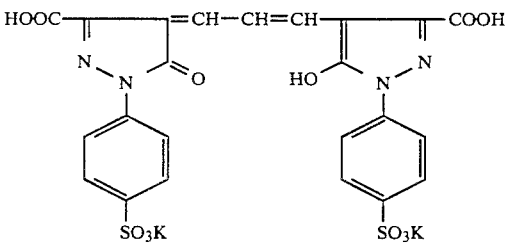

After exposure, sample Nos. 14, 15 and 16 were processed by the following schedule.

| Processing steps (31° C.) | Time |
|---|---|
| 1. Color development | 3 min |
| 2. Bleach-fixing | 1 min |
| 3. Rinsing | 2 min |
| 4. Stabilizing | 1 min |
| 5. Rinsing | 2 min |

The processing solutions used had the following compositions.

| | |
|---|---|
| Color developer | |
| 4-Amino-3-methyl-N-ethyl-N-(β-hydroxyethyl)-aniline sulfate | 4.8 g |
| Anhydrous sodium sulfite | 4.0 g |
| Hydroxylamine hemisulfate | 2.0 g |
| Anhydrous potassium carbonate | 28.0 g |
| Potassium bromide | 1.5 g |
| Potassium hydroxide | 1.0 g |
| Water to make | 1,000 ml |
| Bleach-fixing solution | |
| Ethylenediaminetetraacetic acid iron (II) salt | 65.0 g |
| Ethylenediaminetetraacetic acid disodium salt | 3.0 g |
| Anhydrous sodium sulfite | 9.5 g |
| Ammonium thiosulfate | 77.5 g |
| Anhydrous sodium carbonate | 4.0 g |
| Water to make | 1,000 ml |
| Fixing solution | |
| Glacial acetic acid | 9 ml |
| Sodium acetate | 3 g |
| Water to make | 1,000 ml |

The densities at the unexposed areas of each of the processed samples were measured and the results are shown in Table 4.

TABLE 4

| Sample | Dye compound | Density at unexposed area blue | green | red |
|---|---|---|---|---|
| 14 | none | 0.03 | 0.03 | 0.02 |
| 15 | illustrative dye compound (43) | 0.03 | 0.03 | 0.02 |
| 16 | comparative dye compound (D) | 0.03 | 0.06 | 0.02 |

As is clear from Table 4, sample No. 15 containing the dye of the present invention was free from staining that occurred in sample No. 16 owing to the color remnant of the comparative dye compound used. Comparison of sensitivity showed that the dye of the present invention caused very small adverse effects on emulsion.

EXAMPLE 5

Preparation of coating solution for emulsion layer:

| | |
|---|---|
| Solution A | |
| Water | 980 ml |
| Sodium chloride | 2.0 g |
| Gelatin | 20 g |
| Potassium hexachloroiridate (0.10% aq. sol.) | 2.8 ml |
| Potassium hexabromorhodate (0.001% aq. sol.) | 2.5 ml |
| Solution B | |
| Water | 380 ml |
| Sodium chloride | 38 g |
| Potassium bromide | 42 g |
| Solution C | |
| Water | 380 ml |
| Silver nitrate | 170 g |

To solution A held at 40° C., solutions B and C were added simultaneously over a period of 80 minutes with pH and pAg being held at 3 and 7.7, respectively. Following 5-min stirring, the pH of the mixture was adjusted to 5.6 with aqueous sodium carbonate. After conventional desalting and rinsing steps, 500 ml of water and 30 g of gelatin were added and the mixture was dispersed at 50° C. for 30 minutes, thereby producing cubic grains that consisted of 35 mol% AgBr and 65 mol% AgCl and which had an average size of 0.27 μm.

To the emulsion, 10 ml of citric acid (1% aq. sol.) and 10 ml of sodium chloride (5% aq. sol.) were added so as to adjust its pH and pAg to 5.5 and 7, respectively. To the so adjusted emulsion, 10 ml of sodium thiosulfate (0.1% aq. sol.) and 7 ml of chloroauric acid (0.2% aq. sol.) were added and ripening was performed at 57° C. to attain a maximum sensitivity.

The so conditioned emulsion was divided into 14 parts, to which 0.1% methanol solutions of infrared spectral sensitizers of the present invention and comparative spectral sensitizers (for their names, see Table 5 below) were added in an amount of 50 ml per mol of silver halide. To each of the mixtures, the following additives were added and the ripening was quenched: 25 ml of a 0.5% solution of 1-phenyl-5-mercaptotetrazole (antifoggant); 180 ml of a 1% solution of 4-hydroxy-6-methyl-1,3,3a,7-tetrazaindene (stabilizer); and 300 ml of a 10% aqueous solution of gelatin.

Thereafter, the following additives were further added: 15 ml of a 10% aqueous solution of sodium tri-i-propylnaphthalenesulfonate (coating aid); 50 ml of a 4% aqueous solution of styrene-maleic acid copolymer and 30 g of a latex of polybutyl acrylate (thickeners); 20 ml of a 20% aqueous solution of hydroquinone and 20 ml of a 10% aqueous solution of potassium bromide (stabilizers); and 50 mg (per gram of gelatin) of the product of reaction between 1 mol of tetraquis(vinylsulfonylmethyl)methane and 0.25 mols of potassium salt of taurine (hardener). After adding an emulsified dispersion (N) of an oil-soluble brightener to give a brightener deposit of 15 mg/m$^2$, the pH of the mixture was adjusted to 5.6 with citric acid, thereby preparing a coating solution for emulsion layer. Preparation of coating solution for anti-halation layer:

To an aqueous solution of gelatin (40 g), a dye compound (see Table 5 below) was added to give a dye deposit of 200 mg/m$^2$. Furthermore, an emulsified dispersion (N) of an oil-soluble brightener was added to give a brightener deposit of 15 mg/m$^2$, and a 4% aqueous solution of styrene-maleic anhydride copolymer was added as a thickener in an amount of 15 ml, thereby preparing a coating solution for anti-halation layer. Preparation of emulsified dispersion (N) of oil-soluble brightener:

Five grams of an oil-soluble brightener (F) was dissolved in a mixed solution of cresylphenyl phosphate (100 ml) and ethyl acetate (100 ml). The entire volume of the solution was mixed with 1,500 ml of a 12% aqueous gelatin solution containing 3 g of sodium tripropylnaphthalene sulfonate and the mixture was emulsified and dispersed by sonication. Thereafter, a latex of poly(butylacrylate) was added in an amount of 10 g on a solids basis so as to prepare an emulsified dispersion(-N)of the oil-soluble brightener.

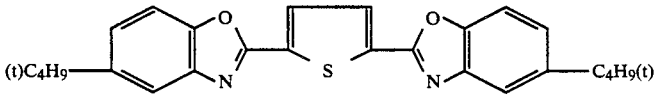

(F)

Preparation of coating solution for protective layer

To an aqueous solution of gelatin, 30 mg/m$^2$ of sodium salt of bis-2-ethylhexyl 2-sulfosuccinate (coating aid), 40 mg/m$^2$of poly(methyl methacrylate) having an average particle size of 4 μm (matting agent), 30 mg/m$^2$ of compound (S) (fluorine-containing surfactant), and 10 mg (per gram of gelatin) of formalin (hardener) were added to prepare a coating solution for protective layer.

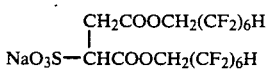

(S)

Preparation and evaluation of samples

The so prepared three coating solutions (one for anti-halation layer, another for emulsion layer, and the third for protective layer) were applied simultaneously onto polyethylene-coated paper 110 μm thick that had a hydrophilic colloidal backing layer and an undercoat layer and which contained 15 wt% $TiO_2$, thus preparing sample Nos. 17–30. Each sample had a silver deposit of 1.4 g/m$^2$ and a gelatin deposit of 1.4 g/m$^2$ in both the anti-halation layer and the emulsion layer and 0.9 g/m$^2$ in the protective layer.

Each of the samples prepared (Nos. 17–30) was divided into two portions, one of which was processed immediately whereas the other portion was put into a polyethylene bag, which was packaged with a paper bag and subjected to a heat treatment in a thermostatic chamber (55° C.×50% r.h.) for 72 hours to investigate aging stability. The two portions (fresh and aging) were subjected to flash exposure ($10^{-5}$ sec) with a xenon flash through an optical wedge and Kodak Wratten Filter No. 88A. Thereafter, the exposed samples were processed with Sakura Autpmatic Processor GR-14 of KONICA Corp. using a developer (G) and a fixing solution (T) (See below). The processed samples were evaluated for their photographic characteristics, Unexposed samples were processed in a similar way to evaluate color remnant. The processing conditions were as follows: 38° C. and 20 seconds for development, ca. 38° C. for 20 seconds for fixing, room temperature and 20 seconds for rinsing, and ca. 40° C. for drying.

| | |
|---|---|
| Developer (G) | |
| Pure water (ion-exchanged water) | ca. 800 ml |
| Potassium sulfite | 60 g |
| Ethylenediaminetetraacetic acid disodium salt | 2 g |
| Potassium hydroxide | 10.5 g |
| 5-Methylbenzotriazole | 300 mg |
| Diethylene glycol | 25 g |
| 1-Phenyl-4,4-dimethyl-3-pyrazolidinone | 300 mg |
| 1-Phenyl-5-mercaptotetrazole | 60 mg |
| Potassium bromide | 3.5 g |
| Hydroquinone | 20 g |
| Potassium carbonate | 15 g |
| Pure water (ion-exchanged water) to make | 1,000 ml |
| pH | ca. 10.8 |
| Fixing solution (T) | |
| Composition A: | |
| Ammonium thiosulfate (72.5% w/v aq. sol.) | 240 ml |
| Sodium sulfite | 17 g |
| Sodium acetate ($3H_2O$) | 6.5 g |
| Boric acid | 6 g |
| Sodium citrate ($2H_2O$) | 2 g |
| Acetic acid (90% w/w aq. sol.) | 13.6 ml |
| Composition B: | |
| Pure water (ion-exchanged water) | 17 ml |
| Acetic acid (50% w/w aq. sol.) | 4.7 g |

-continued

| | |
|---|---|
| Aluminum sulfate (aq. sol. with $Al_2O_3$ content of 8.1% w/w) | 26.5 g |

Just prior to use, solutions A and B were dissolved, in that order, in 500 ml of water and the mixture was worked up to a total volume of 1,000 ml. The so prepared fixing solution had a pH of ca. 4.3.

The results are shown in Table 5. Sensitivity is the reciprocal of the amount of exposure necessary to provide a density of 1.0 and is shown in terms of a relative value, with the value for sample No.17 being taken as 100.

As for the samples that were processed without exposure, color remnant was evaluated visually and rated on a fivescore basis: 5, colorless; 1, extensive color remnant of blue-shade; 3 and below, unacceptable level.

As is clear from Table 5, sample Nos. 17–23 within the scope of the present invention were satisfactory in terms of both sensitivity and color remnant and experienced only small deterioration with time.

Comparative infrared spectral sensitizer (a)

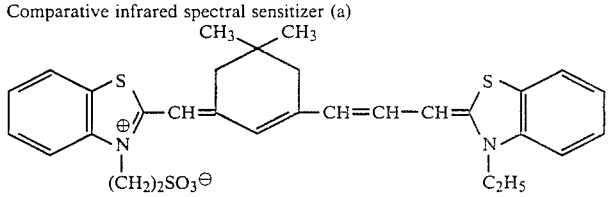

Comparative infrared spectral sensitizer (b)

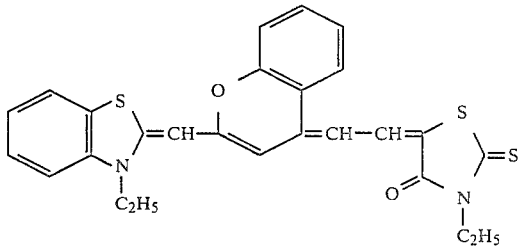

Comparative dye compound (E)

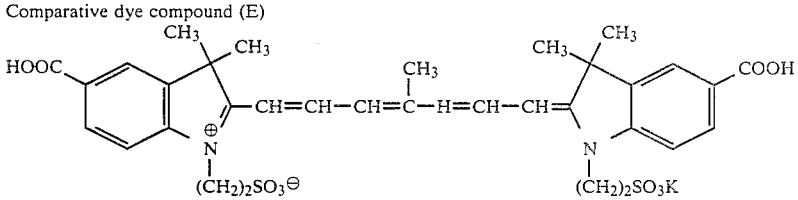

Comparative dye compound (F)

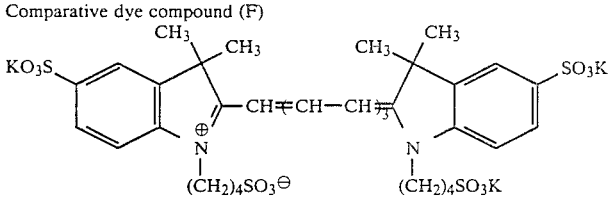

TABLE 5

| Sample No. | Dye compound | Spectral sensitizer | Performance of fresh speciman: Sensitivity | Fog | Color remnant | Performance of aging specimen: Sensitivity | Fog | Color remnant | Remarks |
|---|---|---|---|---|---|---|---|---|---|
| 17 | (1) | II-4 | 118 | 0.01 | 4 | 115 | 0.01 | 4 | Invention |
| 18 | (2) | II-4 | 121 | 0.01 | 5 | 119 | 0.01 | 5 | " |
| 19 | (4) | II-4 | 113 | 0.01 | 5 | 113 | 0.01 | 5 | " |
| 20 | (6) | II-16 | 103 | 0.01 | 5 | 105 | 0.01 | 5 | " |
| 21 | (12) | II-16 | 108 | 0.02 | 4 | 109 | 0.02 | 4 | " |
| 22 | (21) | II-16 | 107 | 0.02 | 4 | 105 | 0.02 | 4 | " |
| 23 | (2) | II-3 and II-4 in equal portions | 124 | 0.01 | 5 | 126 | 0.01 | 5 | " |
| 24 | — | a | 101 | 0.02 | 5 | 47 | 0.03 | 4 | Comparison |
| 25 | E | II-4 | 111 | 0.02 | 2 | 77 | 0.04 | 2 | " |
| 26 | F | II-4 | 116 | 0.03 | 3 | 85 | 0.05 | 2 | " |
| 27 | A | II-4 | 110 | 0.03 | 3 | 80 | 0.05 | 2 | " |
| 28 | B | II-4 | 115 | 0.02 | 2 | 78 | 0.06 | 2 | " |
| 29 | C | II-4 | 109 | 0.03 | 2 | 75 | 0.05 | 2 | " |

TABLE 5-continued

| Sample No. | Dye compound | Spectral sensitizer | Performance of fresh speciman | | | Performance of aging specimen | | | Remarks |
|---|---|---|---|---|---|---|---|---|---|
| | | | Sensitivity | Fog | Color remnant | Sensitivity | Fog | Color remnant | |
| 30 | D | II-4 | 113 | 0.03 | 2 | 65 | 0.05 | 1 | " |

EXAMPLE 6

Gelatin (60 g) was dissolved in water. To the solution, one of the dye compounds shown in Table 6 was added in an amount of 2.0 g, followed by addition of 40 ml of a 1% aqueous solution of sodium 1-decyl-2-(3-isopentyl)succinato-2-sulfonate (spreading agent) and 45 ml of a 4% aqueous solution of glyoxal (hardener). The total amount of the mixture was adjusted to 1,000 ml. The resulting gelatin-containing aqueous solution was applied to a polyethylene terephthalate film base to give a gelatin deposit of 3.2 g/m$^2$. In a separate step, a silver chlorobromide emulsion (62 mol% AgCl, 38 mol% AgBr, av. grain size 0.26 μm, cubic grains) was prepared as in Example 5. After gold and sulfur sensitization, 4-hydroxy-6-methyl-1,3,3a,7-tetrazaindene and 1-phenyl-5-mercaptotetrazole were added to the emulsion in respective amounts of 1.5 and 0.2 g per mole of silver halide. The mixture was divided into 10 portions, to which 0.1% methanol solutions of infrared spectral sensitizers (see Table 6 below) were added in an amount of 50 ml per mole of silver halide. To the mixtures, the following additives were added and stirred: 50 ml of a 10% methanol solution of hydroquinone (antifoggant); 19 ml of a 20% aqueous saponin solution (spreading agent); 50 ml of a 4% aqueous solution of styrene-maleic acid copolymer and 30 g of a latex of poly(ethyl acrylate) (thickeners); and 20 ml of a 1% aqueous solution of 1-hydroxy-3,5-dichlorotriazine sodium salt and 10 ml of 4% formalin hardeners). Each of the resulting coating solutions was applied to the other side of the film base which was not coated with gelatin. The coating thus formed was overlaid with a protective layer applied from an aqueous solution containing gelatin and sodium 1-decyl-2-(3-isopentyl)succinato-2-sulfonate, thereby preparing sample Nos. 31–40.

These samples were processed as in Example 5 and their photographic characteristics were evaluated. Evaluation of aging stability was conducted by the following method: each of the samples was divided into two parts, one of which was humidified to 48% r.h. at 23° C., wrapped hermetically with a moisture-proof material laminated with a polyvinyl acetate film (100 μm), and heated in a thermostatic chamber at 55° C. and 50% r.h. for 72 h. The results are shown in Table 6, in which sensitivity is expressed in terms of a relative value as in Example 5, with the value for sample No. 31 being taken as 100.

As Table 6 shows, the samples of the present invention were satisfactory in terms of both sensitivity and color remnant and experienced only small deterioration with time.

EXAMPLE 7

An additional sample was prepared as in Example 6 except that the silver chlorobromide was replaced by silver iodobromide (2 mol% AgI, 98 mol% AgBr, ave. grain size 0.9 μm, cubic grains). This sample was also satisfactory in terms of both sensitivity and color remnant while exhibiting good aging stability.

TABLE 6

| Sample No. | Dye compound | Spectral sensitizer | Performance of fresh speciman | | | Performance of aging specimen | | | Remarks |
|---|---|---|---|---|---|---|---|---|---|
| | | | Sensitivity | Fog | Color remnant | Sensitivity | Fog | Color remnant | |
| 31 | (1) | II-3 and II-4 in equal portions | 120 | 0.04 | 4 | 115 | 0.04 | 4 | Invention |
| 32 | (2) | II-3 and II-4 in equal portions | 125 | 0.04 | 5 | 119 | 0.04 | 5 | " |
| 33 | (12) | II-3 and II-4 in equal portions | 118 | 0.04 | 4 | 115 | 0.04 | 4 | " |
| 34 | (13) | II-3 and II-4 in equal portions | 122 | 0.04 | 5 | 123 | 0.04 | 5 | " |
| 35 | (19) | II-8 | 113 | 0.04 | 4 | 111 | 0.04 | 4 | " |
| 36 | (26) | II-8 | 110 | 0.04 | 5 | 105 | 0.04 | 5 | " |
| 37 | E | II-16 | 110 | 0.04 | 2 | 88 | 0.06 | 2 | Comparison |
| 38 | F | II-16 | 114 | 0.04 | 3 | 94 | 0.06 | 2 | " |
| 39 | (2) | a | 95 | 0.04 | 5 | 50 | 0.08 | 3 | " |
| 40 | (2) | b | 104 | 0.04 | 5 | 56 | 0.18 | 3 | " |

As shown in detail above, the present invention provides a silver halide photographic material that has high sensitivity, that is affected with less color remnant, that permits easy decoloration during photographic processing and that experiences very small deterioration in photographic performance during storage. The present invention also provides a silver halide photographic material that is sensitized for infrared light and which yet retains the features described above.

What is claimed is:

1. A silver halide photographic material having a hydrophilic colloidal layer that contains at least one cyanine dye which has in its dye molecule at least two acid groups or at least two substituents each having at least one —$CH_2CH_2OR$ group (where R is a hydrogen atom or an alkyl group) wherein said cyanine dye is selected from the group consisting of the compounds represented by the following general formulas (I), (II) and (III):

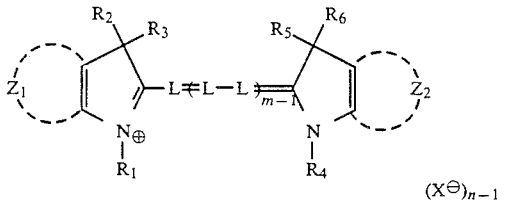

(I)

$(X^{\ominus})_{n-1}$

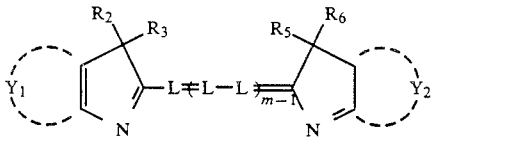

(II)

$(X^{\ominus})_{n-1}$

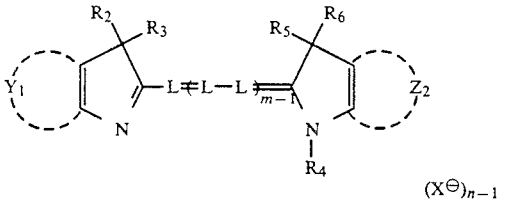

(III)

$(X^{\ominus})_{n-1}$ where $R_1$, $R_2$, $R_3$, $R_4$, $R_5$ and $R_6$ each represents an alkyl group; $Z_1$ and $Z_2$ each represents the group of non-metallic atoms necessary to form a pyrrolopyridine, thienopyrrole or furopyrrole ring;

$Y_1$ and $Y_2$ each represents the group of non-metallic atoms necessary to form a pyrrolopyridine ring, provided that the ring $Y_1$ contains

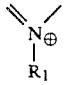

bond and the ring $Y_2$ contains

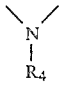

bond;

L is a methine group, $X^-$ is an anion; m is an integer of 4–5; and n is an integer of 1 or 2, provided that n is 1 when the dye forms an intramolecular salt.

2. A silver halide photographic material according to claim 1, wherein said cyanine dye is a hepta- or nonamethine cyanine dye.

3. A silver halide photographic material according to claim 1, wherein said cyanine dye is coated in an amount of 1–800 mg per square meter of said silver halide photographic material.

4. A silver halide photographic material according to claim 1, wherein R in said —$CH_2CH_2OR$ group is a lower alkyl group having no more than 4 carbon atoms.

5. A silver halide photographic material according to claim 1, wherein said acid group is selected from among a sulfonic acid group, a carboxylic acid group and a phosphonic acid group.

6. A silver halide photographic material according to claim 1, wherein said acid group includes an alkali metal salt.

7. A silver halide photographic material according to claim 1, wherein said acid group includes an organic ammonium salt.

8. A silver halide photographic material according to claim 6, wherein said alkali metal salt is a sodium or potassium metal salt.

9. A silver halide photographic material according to claim 7, wherein said organic ammonium salt is selected from among salts of ammonium, triethylamine and pyridine.

10. A silver halide photographic material according to claim 1, wherein said substituent having at least one —$CH_2CH_2OR$ group (where R is a hydrogen atom or an alkyl group) is selected from among hydroxyethyl, hydroxyethoxyethyl, methoxyethoxyethyl, hydroxyethylcarbamoylmethyl, hydroxyethoxyethylcarbamoylmethyl, N,N-dihydroxyethylcarbamoylmethyl, hydroxyethylsulfamoylethyl and methoxyethoxyethoxycarbonylmethyl.

11. A silver halide photographic material according to claim 1, wherein $R_1$, $R_2$, $R_3$, $R_4$, $R_5$ and $R_6$ in the general formulas (I), (II) and (III) each represents a lower alkyl group having 1–8 carbon atoms.

12. A silver halide photographic material according to claim 1 that has at least one silver halide emulsion layer on a base support, said emulsion layer being spectrally sensitized with at least one spectral sensitizer selected from the group consisting of cationic di- and tri-carbocyanine dyes.

13. A silver halide photographic material according to claim 12, wherein said spectral sensitizer is selected from the cationic di- and tri-carbocyanine dyes represented by the following general formula (II-a) or (II-b):

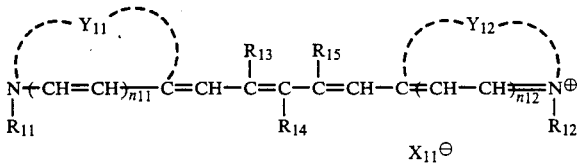

(II-a)

$X_{11}^{\ominus}$

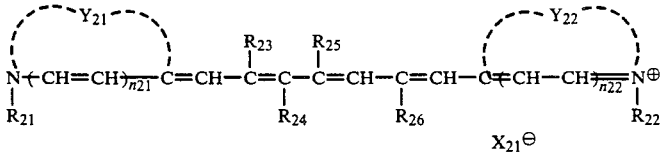

(II-b)

$X_{21}^{\ominus}$ where $Y_{11}$, $Y_{12}$, $Y_{21}$ and $Y_{22}$ each represents the group of non-metallic atoms necessary to complete a 5- or 6-membered nitrogenous hetero ring; $R_{11}$, $R_{12}$, $R_{21}$ and $R_{22}$ each is selected from among substituted or unsubstituted alkyl, aryl and aralkyl groups; $R_{13}$, $R_{14}$, $R_{15}$, $R_{23}$, $R_{24}$, $R_{25}$ and $R_{26}$ each is selected from among a hydrogen atom, substituted or unsubstituted alkyl, alkoxy, phenyl, benzyl and

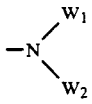

groups (where $W_1$ and $W_2$ each represents a substituted or unsubstituted alkyl or aryl group); $X_{11}$ and X21 each represents an anion; and $n_{11}$, $n_{12}$, $n_{21}$ and $n_{22}$ each represents 0 or 1.

14. A silver halide photographic material according to claim 13, wherein $Y_{11}$, $Y_{12}$, $Y_{21}$ and $Y_{22}$ in said general formulas (II-a) and (II-b) each is selected from among a benzothiazole ring, a naphthothiazole ring, a benzoselenazole ring, a naphthoselenazole ring, a benzoxazole ring, a naphthoxazole ring, a quinoline ring, a 3,3-dialkylindolenine ring, a benzimidazole nucleus, and a pyridine ring.

15. A silver halide photographic material according to claim 13, wherein $Y_{11}$, $Y_{12}$, $Y_{21}$ or $Y_{22}$ in said general formulas (II-a) and (II-b) each is substituted by a lower alkyl group, an alkoxy group, a hydroxyl group, an aryl group, an alkoxycarbonyl group or a halogen atom.

16. A silver halide photographic material according to claim 13, wherein $R_{13}$ and $R_{15}$ as well as $R_{23}$ and $R_{25}$ in said general formulas (II-a) and (II-b) combine to form a 5- or 6-membered ring.

17. A silver halide photographic material according to claim 13, wherein $W_1$ may combine with $W_2$ to form a 5- or 6-membered nitrogenous hetero ring.

18. A silver halide photographic material according to claim 13, wherein the substituted or unsubstituted alkyl group represented by each of $W_1$ and $W_2$ in said group

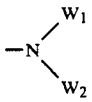

(has 1–18 carbon atoms.

19. A silver halide photographic material according to claim 13, wherein the substituted or unsubstituted alkyl group represented by each of $W_1$ and $W_2$ in said group

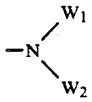

has 1–4 carbon atoms.

20. A silver halide photographic material according to claim 12, wherein said spectral sensitizer is incorporated in the silver halide emulsion layer in an amount ranging from 1 mg to 2 g per mole of silver halide.

21. A silver halide photographic material according to claim 12, wherein said spectral sensitizer is incorporated in the silver halide emulsion layer in an amount ranging from 5 mg to 1 g per mole of silver halide.

22. A silver halide photographic material according to claim 1, wherein said hydrophilic colloidal layer is a silver halide light-sensitive emulsion layer.

23. A silver halide photographic material according to claim 1, wherein said hydrophilic colloidal layer is a non-light-sensitive layer.

24. A silver halide photographic material according to claim 23, wherein said non-light-sensitive layer is a backing layer.

25. A silver halide photographic material according to claim 23, wherein said non-light-sensitive layer is an antihalation layer.

26. A silver halide photographic material according to claim 23, wherein said non-light-sensitive layer is a filter dye layer.

* * * * *